United States Patent [19]

McGowan et al.

[11] Patent Number: 4,601,730

[45] Date of Patent: Jul. 22, 1986

[54] AIR SUPPLY GRATE AND ASH REMOVAL SYSTEM FOR WOOD GASIFIER

[75] Inventors: Thomas F. McGowan, Atlanta; R. Lynnard Tessner, Elberton; Robert A. Cassanova, Tucker; William S. Bulpitt, Atlanta, all of Ga.

[73] Assignee: Georgia Tech Research Corporation, Atlanta, Ga.

[21] Appl. No.: 630,641

[22] Filed: Jul. 13, 1984

Related U.S. Application Data

[63] Continuation-in-part of Ser. No. 408,199, Aug. 16, 1982, abandoned.

[51] Int. Cl.[4] ..... C10J 3/34; C10J 3/42

[52] U.S. Cl. ..... 48/76; 48/66; 48/87; 48/111

[58] Field of Search ..... 48/111, 63, 66, 87, 48/126, 76, 77; 110/298; 126/102 R

[56] References Cited

U.S. PATENT DOCUMENTS 2,166,849 7/1939 Slade ..... 48/72

3,460,491 8/1969 Bryk et al. ..... 110/69

*Primary Examiner*—Peter Kratz

*Attorney, Agent, or Firm*—Newton, Hopkins & Ormsby

[57] ABSTRACT

A fixed bed gasifier for wood or other solid fuel has an air supply grate or grid spanning its interior horizontally substantially above the floor of the gasifier reactor vessel. The air supply tubes forming the grid are widely spaced apart to offer minimal resistance to the downward movement of ash in the reactor vessel. The ends of the grid tubes are supported by stuffing boxes on the side wall of the reactor vessel. An ash removal auger communicates with an ash pit at the bottom of the gasifier reactor vessel and a separately powered rotating ash plow operates in the ash pit above the ash removal auger and below the level of the air supply grate or grid.

14 Claims, 5 Drawing Figures

AIR SUPPLY GRATE AND ASH REMOVAL SYSTEM FOR WOOD GASIFIER

CROSS-REFERENCE TO RELATED APPLICATION

This application is a continuation-in-part of prior copending application Ser. No. 06/408,199, filed Aug. 16, 1982, for Air-Cooled Grate and Ash Removal System for Wood Gasification, now abandoned.

BACKGROUND OF THE INVENTION

1. Field of the Invention

The present invention relates to a wood gasifier of the fixed bed type, and more particularly relates to an air supply grate or grid for such a gasifier which is self-cooling in operation. The invention additionally relates to an ash removal system for a gasifier of the above type used in conjunction with the air supply self-cooling grate or grid.

2. Description of the Prior Art

The gasification of wood and other solid fuels to produce a gaseous fuel is well known. Gasifiers for this purpose involve an endothermic reaction of steam with a burning fuel in a reactor vessel which is also supplied with a controlled amount of air. Wood gasifiers can be of the fluidized bed or fixed bed types and can operate continuously or cyclically.

In the known prior art, wood gasifiers typically involve a grate structure for the support or partial support of the fuel bed near and above the floor of the reactor vessel of the gasifier. There may be a void forming an ash plenum below the grate structure in the prior art gasifier. The grate may be in the form of a pinhole grate through which combustion air may enter the reactor vessel. Pinhole grates consisting of closely spaced grate tubes or members are satisfactory for fluidized bed gasifiers but are unsatisfactory for fixed bed gasifiers because they block or impede the downward movement of ash toward the floor of the reactor vessel, frequently causing clogging and slagging of the grate as well as grate burn-out. Some pinhole grates require internal passages for water coolant to avoid burnout. Moreover, the ash removal systems utilized in the prior art solid fuel gasifiers have tended to produce slag or clinker and have required relatively complex air locks or seals to prevent the air in the reactor vessel from escaping with the ash.

SUMMARY OF THE INVENTION

It is the objective of the present invention to provide a wood gasifier of the fixed bed type which will avoid the drawbacks of the prior art. More particularly, it is the objective of the invention to provide a wood gasifier having a reactor vessel on the side wall of which is supported an improved air supply grate or grid which spans the interior of the vessel and offers minimal resistance to the downward movement of ash toward the floor of the reactor vessel while delivering combustion air to the vessel in a self-cooling mode, thereby avoiding burn-out, slagging and clogging.

It is a further object of the invention to provide an improved ash extraction system for fixed bed solid fuel gasifiers including independently powered ash plow and auger conveyor components which operate adjacent to the bottom of the ash pit in the reactor vessel below the air supply grate or grid and in conjunction with the latter.

In accordance with the invention, an air supply grate or grid is formed by a plurality of widely spaced horizontal grid tubes arranged at a common elevation well above the floor of the reactor vessel and having their opposite ends adjustably held in stuffing boxes mounted on opposite portions of the reactor vessel side wall. The central portions of the tubes forming the air supply grid are rectangular in cross section and somewhat elongated along one transverse axis. Spaced air supply nozzles on the rectangular grid tube portions project transversely from one wall of the rectangular portion of each grid tube to direct air into the reactor vessel chamber at a chosen angle. The nozzles are preferably covered by screens to block the entry of ash into the grid tubes and to provide a balanced flow of air into the reactor vessel chamber. The opposite end portions of the air supply grid tubes are cylindrical to allow rotational adjustment within the stuffing boxes and/or removal at required times and also to allow thermal expansion of the grid tubes.

During the operation of the gasifier, ash which is formed moves gradually downwardly to the floor of the reactor vessel which supports the fixed fuel bed. The air supply grate or grid is not relied upon to support the settled bed and offers very minimal resistance to the downward movement of the ash due to the wide spacing of the tubes forming the grate or grid. Rotational adjustment of the rectangular cross-section grid tubes assists in avoiding slagging or clinkering and tends to prevent bridging of the fixed bed of ash with the air supply grid. The separately driven ash plow and ash extraction auger near the floor of the reactor vessel removes ash in a controlled and efficient manner independently of the air supply grate or grid. The air supply grid being self-cooling can be formed of non-alloying steel for greater economy of manufacture.

Other features and advantages of the invention will become apparent to those skilled in the art during the course of the following description.

DETAILED DESCRIPTION OF THE PREFERRED EMBODIMENT

Figure 1:
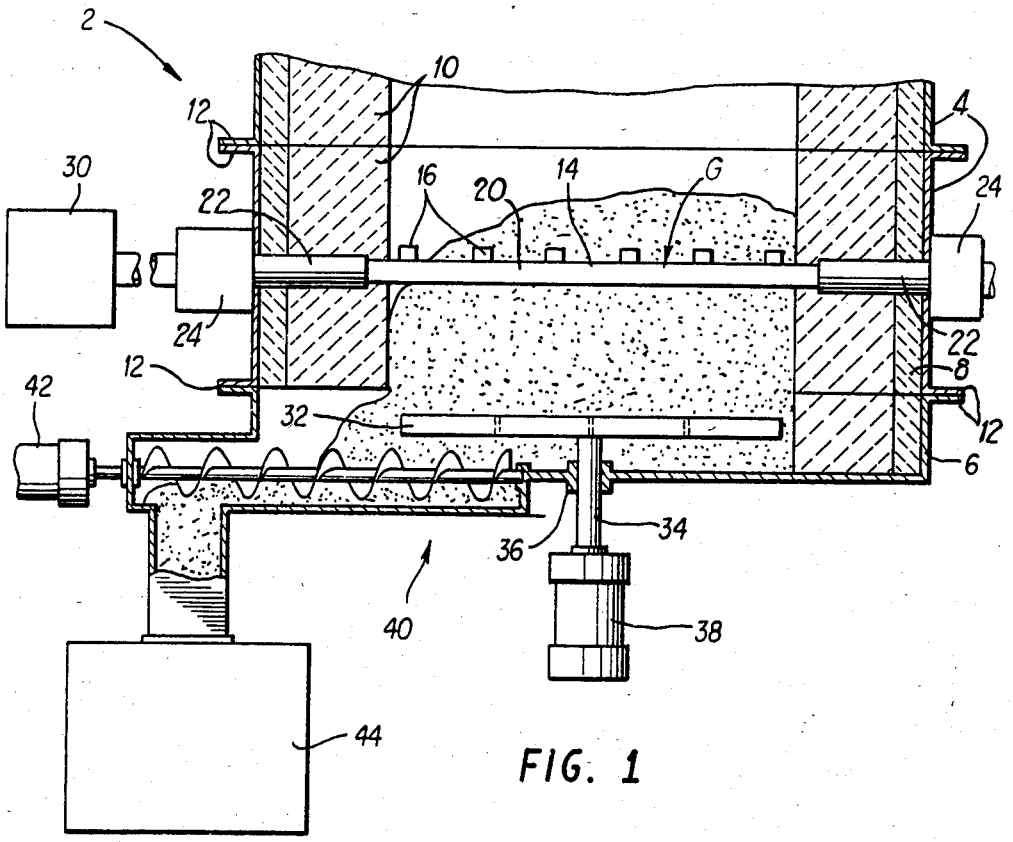
FIG. 1 is a fragmentary partly schematic vertical section through the lower portion of a wood gasifier reactor vessel equipped with an air supply grid and ash removal system according to the present invention.
Figure 4:
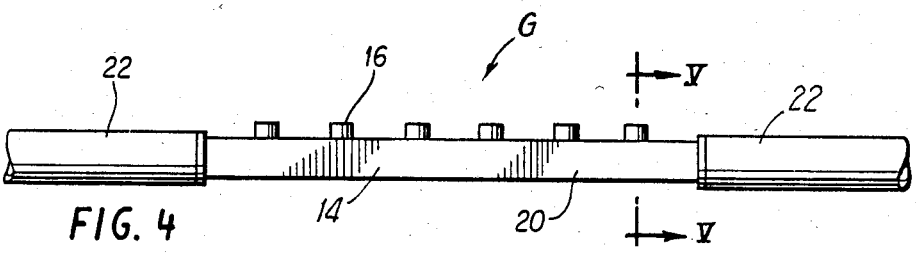
FIG. 4 is a side elevation of an air supply grid tube.

Referring to the drawings in detail wherein like numerals designate like parts, chip wood or other appropriate solid fuel forms a fixed or settled bed in the chamber of a gasifier reactor vessel 2. The reactor vessel consists of one or more ring sections 4 and a floor section 6 defining an ash pit at the bottom of the reactor vessel. The preferably steel reactor vessel 2 is lined with a layer of insulation 8, such as flexible ceramic material and fire bricks 10 or other suitable refractory material. The ring sections 4 are stacked end-to-end and their abutting end flanges 12 are rigidly connected by bolting or welding.

The floor of the reactor vessel defined by the floor section 6 supports the ash bed which is constantly being formed in the reactor vessel 2 and settling downwardly during the gasification process therein. Added wood in chip form or other appropriate solid fuel is supported on the ash bed as it is introduced into the gasifier reactor vessel. The introduction of steam into the vessel to enable the well-known endothermic reaction is not a part of the present invention and may be conventional.

As shown in FIG. 1, the ash in the reactor vessel extends two or three inches above the air supply grid G forming a main feature of the present invention. The additional wood fuel, not shown, rests on the ash bed, as previously stated.

Figure 5:
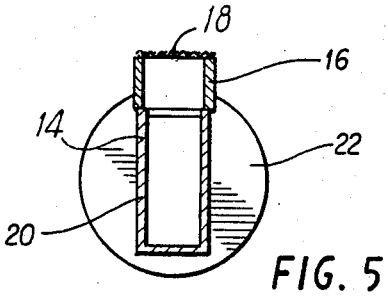
FIG. 5 is an enlarged transverse vertical section taken on line V—V of FIG. 4.
Figure 2:
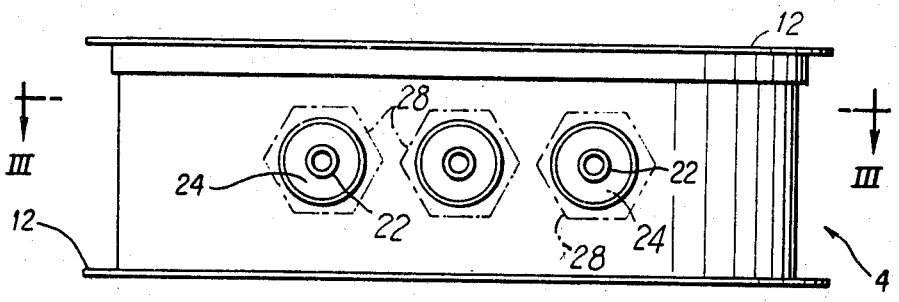
FIG. 2 is a side elevation showing one annular section of the reactor vessel and the stuffing boxes mounted on one side thereof.
Figure 3:
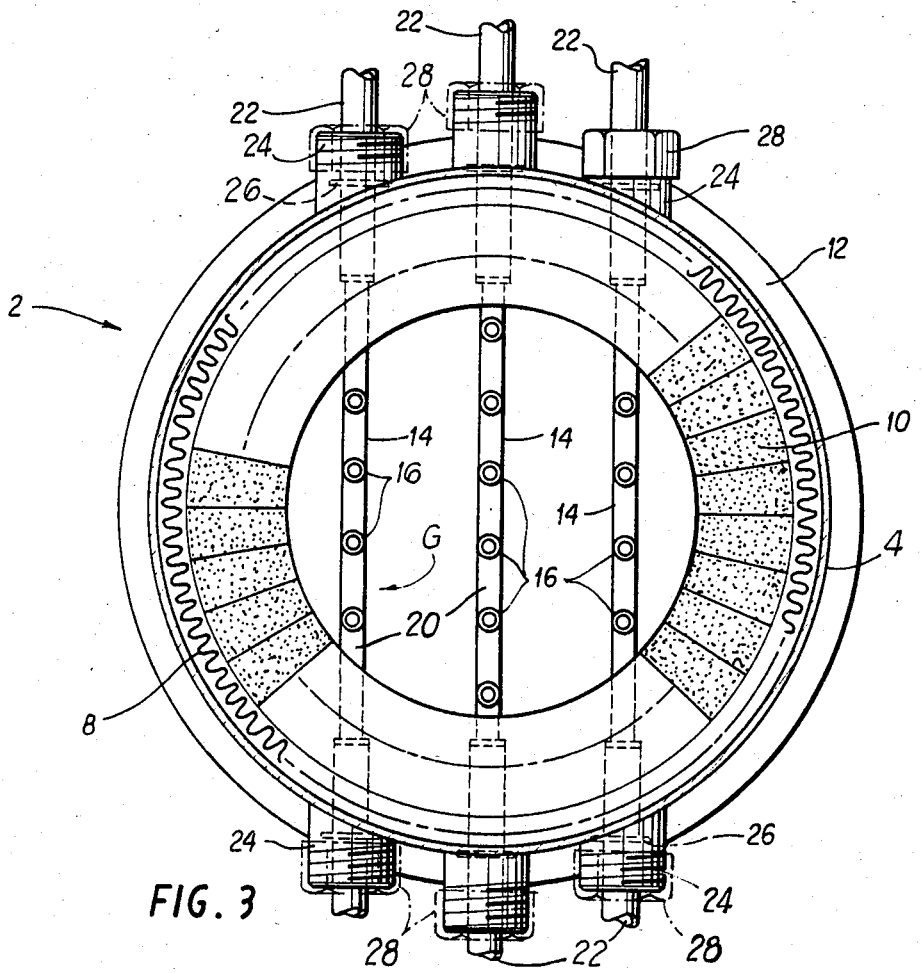
FIG. 3 is a horizontal section taken substantially on line III—III of FIG. 2.

The air supply grid G comprises a plurality of equidistantly spaced horizontal parallel tubes 14 whose center sections 20 are rectangular in cross-section and elongated on one transverse axis, FIG. 5. Typically, the rectangular tube sections 20 are about twice as deep as they are wide. The rectangular tube sections 20 span the interior chamber of the reactor vessel 2. The end portions 22 of the air supply grid tubes 14 are cylindrically formed and are received within openings formed in the reactor vessel side wall. The cylindrical end portions 22 are held within stuffing boxes 24 fixedly secured to the side wall of the lowermost ring section 4 of the reactor vessel. The stuffing boxes are filled with high temperature packings retained by retainer rings 26, FIG. 3. The ends of the stuffing boxes 24 are covered and sealed by screw-threaded caps 28.

The described stuffing box support for the air supply grid tubes 14 on the reactor side wall enables free rotational and/or longitudinal adjustment of the tubes, ready inspection, blowing-out and easy removal of the tubes 14 at required times.

Secured to one flat face of the rectangular section 20 of each tube 14 are equidistantly spaced short air supply nozzles 16 whose axes are at right angles to the tubes 14. The ends of the nozzles 16 are covered by preferably nichrome wire screens 18 to block the passage of ash through the nozzles into the tubes 14, the nozzles being normally embedded in ash as depicted in FIG. 1. The number of nozzles 16 along the air supply grid tubes 16 may be varied in the invention.

The rectangular formation of the center sections 20 of tubes 14 increases their strength, and when the longer transverse axes of the rectangular tubes are parallel and vertical, the total area of the grate or grid impeding the downward movement of ash is minimized to the least degree possible. The described rotational adjustability of the tubes 14 allows the air supply nozzles 16 to be directed in any desired manner within the chamber of the reactor vessel, the drawings showing the nozzles 16 extending upwardly vertically.

An important characteristic of the air supply grid G is the very wide spacing of the tubes 14 and the self-cooling capability thereof utilizing the cooling effect of the air being delivered therethrough. Preferably, the space between the tubes 14 should be at least twice the collective width of the tubes or an even greater tube spacing, as shown in the drawings. At least two-thirds of the surface area across the reactor vessel chamber should be open and unobstructed so that the downward flow of ash will be impeded by the grate or grid G in only a very minimal degree. This distinguishes the invention from prior art settled bed solid fuel gasifiers and is a key feature in eliminating the stated disadvantages caused by conventional grates in such gasifiers which impede the movement of ash leading to bridging, clinkering of ash and burn-out of grates caused by overheating. The larger the horizontal surface area present in the grate or grid, the greater is the tendency for overheating and burn-out. In the present invention, air flow to surface area ratio in the grid G is far greater than in the prior art.

As stated previously, the second major aspect of the invention comprises an improved ash removal system operating in concert with the air supply grid G. Downwardly moving ash in the reactor vessel 2 is acted on near and above the floor of the reactor vessel and well below the grid G by a vertical axis rotating ash plow 32 carried by a shaft 34, powered by an external motor 38. The ash plow 32 spans the reactor vessel chamber substantially horizontally.

Closely below the ash plow 32 is an ash extraction auger 40 driven by a separate and independent motor 42. The auger 40 transports the ash acted upon by the ash plow to a sealed ash tank 44. Thus, the possibility of compressed air escaping from the reactor vessel with the ash is eliminated, and the necessity for complex air locks or water seals is obviated.

Pressurized air is delivered to the grid tubes 14 at corresponding ends thereof from a conventional air source 30. The opposite corresponding ends of the grid tubes are closed and sealed. As the rectangular sections 20 of the tubes have small horizontal surfaces exposed to the hot ash, the air supplied from the source 30 cools the air supply grid tubes most effectively.

In the present invention, the air supply grate or grid G does not function as a grate in the traditional sense. There is no support or retention of the ash by the tubes 14, as previously explained. There is no ash plenum in the sense of a void below the grid G and the ash of the fixed fuel bed completely fills the space between the grid G and the floor of the reactor vessel. The ash also forms an insulation layer above the grid tubes 14 helping to insulate them from the combustion zone of the fixed bed at a higher elevation in the reactor vessel. The height of the ash relative to the grid G is controlled by the ash extraction rate, which can be monitored by state-of-the-art temperature probes in the bed and/or by gas composition and temperature monitoring.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. In a solid fuel gasifier, a reactor vessel containing a fixed bed of fuel and ash supported by the floor of the vessel and the hot ash moving downwardly toward said floor during the operation of the gasifier, an air supply grid including a plurality of spaced parallel grid tubes spanning the interior of the reactor vessel at an elevation above said floor and being substantially within the hot ash of said fixed bed, the opposite ends of the grid tubes being supported by the side wall of the reactor vessel and being rotationally and axially adjustable, the spacing of the grid tubes being such that their collective horizontal surface area equals less than one-third of the horizontal surface area across the reactor vessel chamber, whereby the grid tubes offer little resistance to the downward movement of ash in the reactor vessel, and cooperative ash removal means within the reactor vessel chamber near said floor and below the air supply grid, said ash removal means including an ash plow operating within the reactor vessel chamber near and above said floor and an ash extraction auger below said ash plow and near said floor, said auger being in communication with said chamber.

2. In a gasifier as defined in claim 1, said spaced parallel grid tubes each having plural spaced air supply nozzles thereon within the reactor vessel chamber and projecting from one side of the tube transversely of the longitudinal axis thereof, and ash blocking air diffusion screens disposed across the bores of said nozzles.

3. In a gasifier as defined in claim 1, and stuffing boxes fixed on the side wall of the reactor vessel and receiving the opposite end portions of said grid tubes, said opposite end portions being cylindrical.

4. In a gasifier as defined in claim 3, and the grid tubes having central rectangular cross-section portions within and spanning the reactor vessel chamber, and air supply aperture means on at least one wall of the rectangular cross-section portion of each grid tube.

5. In a gasifier as defined in claim 4, and the rectangular cross-section portions of the grid tubes being elongated on one transverse axis, and the air supply aperture means being coaxial with said one transverse axis.

6. In a solid fuel gasifier as defined in claim 1, and a sealed containment for ash extraction by said auger exteriorly of the reactor vessel and being in communication with the auger and reactor vessel chamber.

7. In a gasifier as defined in claim 6, and the ash plow and auger having vertical and horizontal rotational axes respectively, and separate and independent rotational drive means for the ash plow and auger exteriorly of the reactor vessel.

8. In a gasifier as defined in claim 1, and an air supply source exteriorly of the reactor vessel connected with and supplying pressurized air to said supply grid.

9. A self-cooling air supply grid in combination with a fixed bed solid fuel gasifier, the gasifier having a floor supporting the fixed bed and having an ash plow and ash extraction means above said floor and below said grid, side wall means extending vertically from the floor defining a reaction chamber, said grid comprising a plurality of side-by-side laterally spaced tubes extending horizontally across the reaction chamber of the gasifier at a common elevation above the floor, means sealingly and rotationally supporting the opposite ends of said tubes on the side wall of the gasifier, spaced parallel axis air supply nozzles on the central portions of the tubes within the reaction chamber of the gasifier, pressurized air supply means exteriorly of the gasifier and being connected to the tubes, and the spacing of the tubes within the reaction chamber of the gasifier being such that their collective horizontal area is no greater than about one-third of the total horizontal area encompassed by the reaction chamber of the gasifier so that the tubes offer very little resistance to the downward movement of ash in the reaction chamber.

10. A self-cooling air supply grid as defined in claim 9, and the portions of said tubes spanning the reaction chamber of the gasifier being of rectangular cross section, and said nozzles being disposed on one wall of the rectangular cross section portion of each tube.

11. A self-cooling air supply grid as defined in claim 9, and said means sealingly and rotationally supporting the opposite end portions of said tubes including stuffing boxes fixed on the side wall of the gasifier.

12. A fixed bed solid fuel gasifier comprising a floor portion with side walls extending vertically therefrom for defining a chamber and supporting the fixed bed, a self-cooling air supply grid having a plurality of parallel, laterally spaced grid tubes having opposed ends and extending horizontally across said chamber at a common elevation above said floor, support means on said side walls outside said chamber for sealingly and rotationally supporting said opposed ends, a plurality of spaced, parallel axis air supply nozzles communicating with said tubes within said chamber, pressurized air supply means disposed outside said chamber and being in communication with said tubes for supplying combustion and cooling air to said tubes, said tubes being spaced apart such that the collective horizontal area of said tubes is no greater than about one-third of the total horizontal area defined by said chamber so that the ash formed in said chamber can fall between said tubes, as ash plow for agitating the fallen ash disposed in said chamber near and above said floor and below said grid, an ash extraction auger disposed below said plow, and a sealed containment means for the ash in communication with said auger.

13. A solid fuel gasifier as defined in claim 12 in which said support means includes stuffing boxes fixed on said side walls.

14. A solid fuel gasifier as defined in claim 13 in which said tubes are of rectangular cross section defined by wall portions, and said nozzles are disposed in one of said wall portions.

* * * * *